US006073275A

United States Patent [19]

Klopocinski

[11] Patent Number: 6,073,275

[45] **Date of Patent: *Jun. 13, 2000**

[54] MULTIFUNCTION TOILET

[76] Inventor: Stanislaw Klopocinski, 38548 Warwickshire, Sterling Heights, Mich. 48312

[ * ] Notice: This patent is subject to a terminal disclaimer.

[21] Appl. No.: 09/124,696

[22] Filed: Jul. 29, 1998

Related U.S. Application Data

[63] Continuation-in-part of application No. 08/713,144, Sep. 12, 1996, Pat. No. 5,813,060.

[51] Int. Cl.[7] ..... E03D 9/052

[52] U.S. Cl. ..... 4/351; 4/213; 4/216; 4/420.2; 4/420.4

[58] Field of Search ..... 4/213, 421, 351, 4/DIG. 13, 420.5, 216, 420.2, 420.4

[56] References Cited

U.S. PATENT DOCUMENTS

| | | | |
|---|---|---|---|
| 591,067 | 10/1897 | Wallace | 4/421 X |
| 2,100,962 | 11/1937 | Juntunen | 4/213 |
| 2,227,920 | 1/1941 | Baither | 4/213 |
| 2,297,935 | 10/1942 | Baither | 4/213 |
| 2,659,897 | 11/1953 | Smith | 4/421 |
| 3,154,793 | 11/1964 | Congdon | 4/420.2 |
| 3,534,415 | 10/1970 | Huffman | 4/213 |
| 3,594,826 | 7/1971 | Maurer | 4/420.2 |
| 3,995,326 | 12/1976 | Umann | 4/420.2 X |
| 4,028,745 | 6/1977 | Caniglia | 4/420.2 |
| 4,103,370 | 8/1978 | Arnold | 4/213 |
| 4,304,016 | 12/1981 | Oguma et al. | 4/420.2 |
| 4,551,868 | 11/1985 | Kawai et al. | 4/443 |
| 4,558,473 | 12/1985 | Morikawa et al. | 4/420.2 |
| 4,616,368 | 10/1986 | Nagai et al. | 4/420.2 |
| 4,628,548 | 12/1986 | Kurosawa et al. | 4/420.4 |
| 4,704,748 | 11/1987 | Takeda et al. | 4/420.4 |
| 4,841,583 | 6/1989 | Ohara et al. | 4/420.4 |
| 4,933,996 | 6/1990 | Sowards | 4/213 |
| 4,987,617 | 1/1991 | Furukawa et al. | 4/448 |
| 5,050,249 | 9/1991 | Takeda et al. | 4/443 |
| 5,054,131 | 10/1991 | Sim | 4/216 |
| 5,079,782 | 1/1992 | Sim | 4/216 |
| 5,203,037 | 4/1993 | Kang | 4/420.4 |
| 5,208,922 | 5/1993 | Machinaga et al. | 4/448 |
| 5,813,060 | 9/1998 | Klopocinski | 4/351 |

*Primary Examiner*—Robert M. Fetsuga
*Attorney, Agent, or Firm*—Gifford, Krass, Groh, Sprinkle, Anderson & Citkowski, P.C.

[57] ABSTRACT

A multifunction toilet is shown with a conventional flushing system and auxiliary components which include an odor exhaust system which withdraws gases from the toilet bowl and delivers them to the sewage drain downstream of the toilet water trap. Other auxiliary components include a motor driven retractable nozzle pipe which provides a personal warm water spray rinse and a dryer which supplies warm drying air. The auxiliary components are operated under a switch control system which assures proper sequencing and prevents use unless the user is seated on the toilet seat.

13 Claims, 13 Drawing Sheets

MULTIFUNCTION TOILET

CROSS REFERENCE TO RELATED APPLICATIONS

The present application is a Continuation-in-Part of application Ser. No. 08/713,144, filed Sep. 12, 1996 for a MULTI-FUNCTION TOILET U.S. Pat. No. 5,813,060.

BACKGROUND OF THE INVENTION

I. Field of the Inivention

This invention relates to a multifunction toilet, and, more particularly, this invention relates to a standard flush toilet having auxiliary features including an odor removal exhaust fan system and a personal cleansing water spray system.

II. State of the Art

There are many ways in which unpleasant or obnoxious toilet odors are dealt with. Most commonly, in both domestic and commercial or public practice, a room exhaust fan is provided, usually in conjunction with a wall mounted switch. In public or business establishments, deodorants are commonly used to primarily mask the undesirable odor. In some systems, air is withdrawn from the toilet bowl and passed through a filter such as a charcoal filter and returned to the room with or without additional deodorizing, such a system being shown in U.S. Pat. No. 3,594,826.

More effective odor control systems remove gas from the toilet bowl and exhaust the gas to the sewer system downstream of the water trap siphon seal in the toilet bowl. This normally requires the use of at least one valve in the exhaust conduit which, primarily for economy, is supplied as a solenoid operated on-off valve in a relatively small air pipe such as valve 36 shown in FIG. 6 of U.S. Pat. No. 3,534,415 or the solenoid operated flapper valve 74 shown in U.S. Pat. No. 3,120,006. A more expensive and larger spring loaded piston type solenoid valve is shown at 48, 50 and 52 in U.S. Pat. No. 4,933,996 in which the fan housing is located in the water tank with the exhaust flow and electrical connection going through the exhaust conduit 40 and with an additional flapper-type check valve 38 being part of the blower assembly 32 located in the water tank between the fan and the exhaust conduit 40 as seen in FIG. 3.

One of the primary purposes of the valve in the exhaust conduit is to prevent backflow of sewer gases into the toilet. Some exhaust systems completely ignore this problem by failing to supply a valve as for example as shown in U.S. Pat. Nos. 5,079,782, 4,993,083 and 3,805,304. Other systems rely on a purely mechanical type of check valve having no water trap such as the ball type check valve 32 in U.S. Pat. No. 5,054,131 or the spring loaded valve 24 shown in FIG. 5 of U.S. Pat. No. 3,534,415 or the flexible valve structure 107, 110 of U.S. Pat. No. 4,103,370.

Some systems utilize a manually operated damper valve as the damper valve 41 in the system shown in U.S. Pat. No. 4,558,473 which employs a single fan for alternately conveying odor exhaust gas and for supplying drying air after the user has employed a personal water rinse.

There are also a wide variety of toilets which are equipped with a nozzle pipe in the toilet bowl to provide a water spray for bathing or cleansing the user's genitals, most of which also supply a warm drying air after the water spray. Some of these bidet type accessories use a fixed or stationary nozzle pipe extending into the toilet bowl such as a system shown in U.S. Pat. Nos. 4,616,368 and 3,154,793. These stationary nozzle pipe systems present sanitary cleaning and corrosion problems.

More of the bidet type accessory systems employ a nozzle pipe which is extended into and retracted from the toilet bowl, some of which are driven by water pressure and the majority of which are driven by an electric motor. Most of the systems provide a tank for heating the nozzle water, and some of the systems provide an optional choice between a gentle spray and a higher pressure spray. Multiposition systems are available as well as systems that employ the use of two nozzle pipes. The nozzle pipe motor and the water valve are typically actuated by a manual user switch or a switch which is closed when the user is seated on the toilet seat. Examples of these washing spray and drying air accessories are shown in U.S. Pat. Nos. 5,050,249, 5,203,037, 4,551,868, 4,704,748, 4,558,473, 4,628,548, 4,304,016, 4,841,583, 4,995,326, 3,594,826, 5,208,922 and 4,987,617.

SUMMARY OF THE INVENTION

The present invention provides a toilet with auxiliary components which include an odor removing fan and a bidet type genital washing spray with an air dryer. The auxiliary components are regulated by a unique control system which allows the user's choice but assures proper sequential use and prevents actuation when the user is not seated.

The invention provides the multifunction flush toilet with a ventilating system including an exhaust fan for withdrawing gases from the toilet bowl for odor control and delivering the gases to the sewage waste drain downstream from the toilet bowl water trap seal. The exhaust fan can only be turned on by the user when the user is seated on the toilet seat, sitting on the seat actuating an enabling switch. The ventilating system provides a water trap valve assembly which is operated by exhaust gas fan pressure, eliminating electric control for the valve, while providing maximum air flow without restriction in the ventilating air conduit and providing complete shutoff against sewer gas backflow with a water seal.

The present invention also equips the toilet with a motor driven retractable nozzle pipe which provides a bidet type genital washing warm water spray which is user operated to produce a gentle low pressure spray or a higher pressure brisk spray followed by an optional warm drying air flow, all regulated by the unique control system which assures the proper sequence functioning and prevents actuation when the user is not seated.

The multifunction toilet includes a toilet bowl with a flushing ring manifold adjacent the top of the bowl and a water trap seal between the bowl and a siphoned outlet to a sewage waste drain. A toilet seat is mounted on the top of the bowl, and a water supply tank incorporates a flushing mechanism with a valve control outlet to the flushing ring manifold and a level control which includes an overflow tube in communication with the bowl. The auxiliary components include an exhaust fan which is connected to an air outlet in the toilet bowl for withdrawing gases from the bowl for odor control. An air conduit is connected to the fan and to the sewage waste drain downstream of the bowl water trap seal. A control system includes an enabling switch which is connected to the exhaust fan and activated by the user sitting on the toilet seat and a user on-off switch which is connected to the exhaust fan. The exhaust fan is turned on only when the user is sitting on the toilet seat and the user switches the user on-off switch to an on position An odor extraction trap and valve assembly is connected to the exhaust fan. The assembly has a water sump and a valve with a moving member extending into the sump in a closed position of the valve to prevent backflow of gas from the gas disposal outlet. When the exhaust fan is operating, it creates an air flow from the bowl air outlet, and the air flow will lift the moving valve member to an open valve position creating an air flow path above the water sump. When the exhaust fan is turned off, the moving valve member will return to its closed position. Fresh water is supplied to the sump each time the toilet is flushed from the flushing mechanism.

In one embodiment, the exhaust fan has a casing with an air inlet and an air outlet. The air inlet is connected to the air outlet in the toilet bowl. An odor extraction trap and valve assembly which has a housing with an air inlet and an air outlet has its air inlet connected to the air outlet of the fan casing. An air conduit connects the air outlet of the housing to the sewage waste drain downstream of the bowl water trap seal. The lower portion of the trap and valve assembly housing contains a water sump which together with an inlet valve define a water trap valve that is closed when the exhaust fan is not operating with the water in the sump preventing backflow of sewer gas through the housing inlet. The water trap valve is opened when the exhaust fan is operating with air flow from the fan lifting the inlet valve, creating an air flow path from the housing inlet above the water sump and through the housing and housing outlet. The housing air inlet includes a vertically oriented tubular member extending upwardly into the housing through the water sump and terminating in an end defining a water level overflow weir. A valve stem guide sleeve is centrally located in the tubular member, and a moving valve member including a circular top plate having a vertically depending valve stem is movably supported in the guide sleeve. A tubular valve skirt depends from the circular top plate of the moving valve member so as to extend into the sump to form a water seal. When the exhaust fan is operating, the inlet valve is lifted so that the tubular valve skirt is lifted above the water sump creating the air flow path.

The extraction trap and valve assembly further includes an inner ring extending upwardly in the sump concentric with the tubular member and defines with the top plate a valve air chamber when the air flow from the exhaust fan lifts the inlet valve to an open position.

Each time that the toilet is flushed, water is supplied to the sump creating an overflow of water over the overflow weir out of the housing inlet and through the fan casing from the casing air outlet to the casing air inlet and into the toilet bowl through the air outlet in the toilet bowl. The fan casing has a water drain bypass conduit with one end connected to the casing between the casing air inlet and the fan and the other end of the bypass being connected to the casing between the fan and the casing outlet. This allows the overflow water to pass through the bypass avoiding the fan.

In another embodiment, the exhaust fan and the odor extraction trap and valve assembly are located in an integral housing with the exhaust fan being located at the top of the housing and the sump being located at the bottom of the housing.

The auxiliary components of the invention also include a nozzle pipe and a nozzle motor for advancing the nozzle pipe into the bowl from a retracted position outside of the bowl to a use position inside the bowl and for retracting the nozzle pipe from the bowl from the use position to the retracted position. A warm water tank is connected to the nozzle pipe with an electrically operated valve. The control system includes a retracted position limit switch, a use position limit switch, and a two position multifunction user switch. When the user is sitting on the toilet seat and he switches the multifunction user switch from an off position to an on position, power will be supplied to the nozzle motor advancing the nozzle pipe into the bowl, opening the retracted position limit switch, and when the nozzle pipe reaches its use position, the use position limit switch will be closed stopping the motor and opening an electrically operated valve to supply warm water through the nozzle pipe to provide a gentle rinse spray. When the user switches the multifunction user switch from the on position to an off position, the electrically operated valve will be closed, shutting off the spray, and power will be supplied to the nozzle motor retracting the nozzle pipe from the bowl. When the nozzle pipe reaches its retracted position, the retracted position limit switch will be closed shutting off the nozzle motor.

In a preferred form of the invention, a second electrically operated valve is used connected in parallel with a first electrically operated valve between the warm water tank and the nozzle pipe so that when warm water is being supplied through the nozzle pipe providing a rinse spray, the user can increase the pressure of the spray by depressing and holding the multifunction user switch in its on position, opening the second electrically operated high pressure valve.

In a preferred form of the invention, a warm air blower is connected to an air inlet in the toilet bowl. When the user is sitting on the toilet seat with the user on-off switch in its on position and the multifunction user switch in its off position with the nozzle pipe in its retracted position, the warm air blower can be turned on to supply drying air by depressing and releasing the multifunction switch in its off position.

Another preferred embodiment of the present invention which can be used with any flushing toilet includes a water saving device which comprises a flexible sleeve which is connected to the siphoned outlet with a clamp. The sleeve has a free end which extends into the sewage waste drain so that when the flushing mechanism is operated, water will flow as a stream through the siphoned outlet and into the sleeve with the sleeve clinging to the stream preventing air from getting into the outlet creating a greater pressure differential from the toilet bowl to the waste drain thereby reducing flushing time and saving water.

BRIEF DESCRIPTION OF THE DRAWING

The advantages of the present invention will be more apparent from the following detailed description when considered in connection with the accompanying drawing wherein.

DETAILED DESCRIPTION

Figure 1:
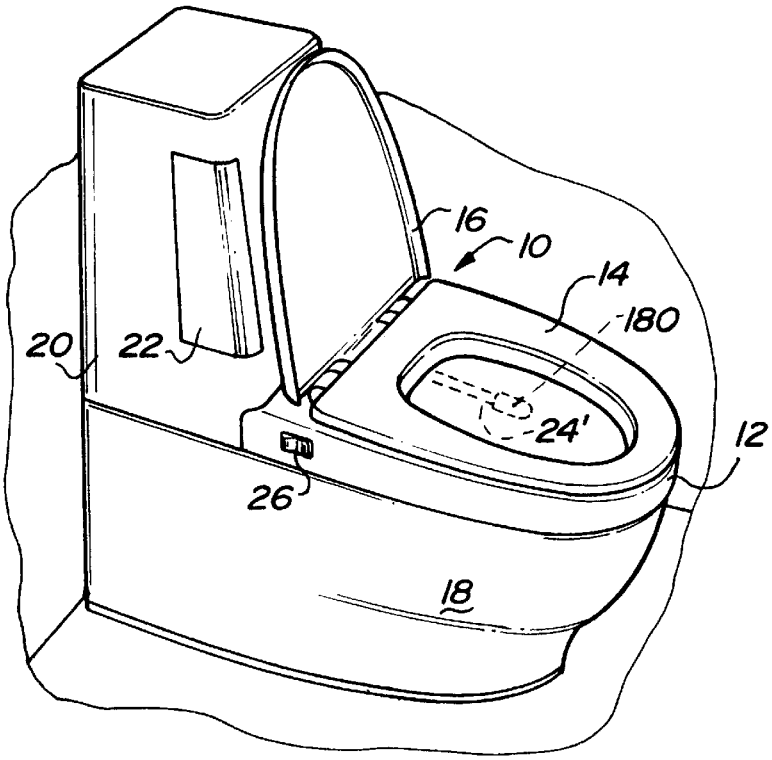
FIG. 1 is a perspective view of the multifunction toilet of this invention.
Figure 2:
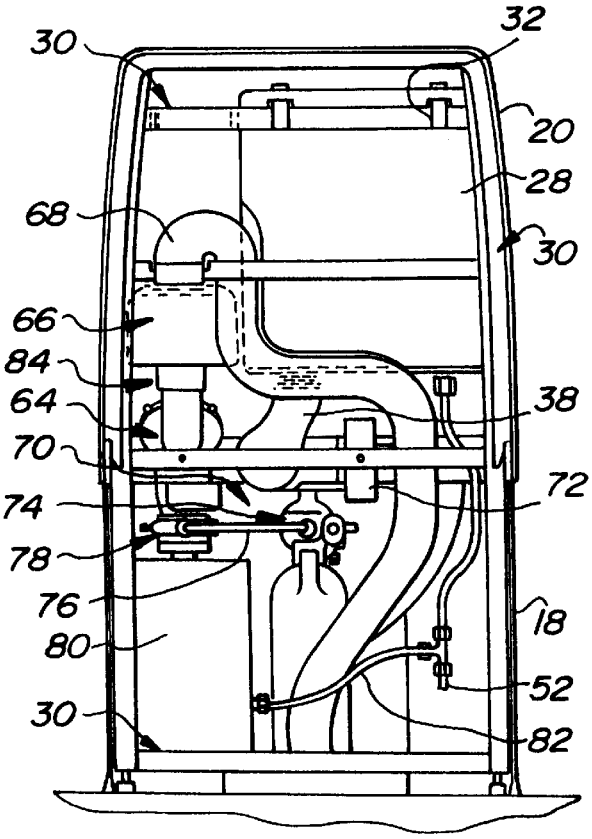
FIG. 2 is a rear ,levational view showing the relative location of many of the component parts.

Referring to FIGS. 1 and 2, the multifunction toilet 10 of this invention is shown to include a china or porcelain bowl 12, a toilet seat 14, a seat cover 16, a plastic base cover 18, an upper plastic cover 20 and a flushing bar 22. Additionally depicted in FIG. 1 is a nozzle pipe 24', shown in phantom, as extending into the bowl 12 from the rear, and a user on-off switch 26, both of which will be explained later.

The flushing components and mechanisms of the toilet are standard and are shown in FIGS. 2, 3, 5, and 7 to include a flushing water tank 28 mounted to steel frame 30 by hooks 32. The toilet is flushed by pressing the flush bar 22 which pivots the flush arm 34 to lift and open the flapper valve 36 by a chain, not shown, between the flapper valve 36 and the arm 34 which releases flushing water from the bottom of the tank through the water tank hose 38 to the bowl flushing water neck 40 and into the flushing ring 42 for delivery through flushing discharge openings 44 and then through the bowl and the water trap 46 to the siphoned discharge passage 48 and the bowl outlet 50 to the sewer waste drain, not shown. The flapper valve 36 will close when the water has been drained from tank 28, and the water will be replenished in the tank from water supply pipe 52 through flow control valve 54 which also supplies water through tube 56 to a tee 58 to the toilet bowl 12 through overflow tube 60 to replenish the trap water and to tubing 62 which supplies water to the sump of the odor extraction assembly to be explained.

Referring to FIG. 2, the auxiliary components of the multifunction toilet include a ventilating system 84 for odor control having an exhaust fan assembly 64 for withdrawing gases from the toilet bowl and passing them through an odor extraction trap and valve assembly 66 and through an outlet hose or conduit 68 to the sewer waste drain through odor extraction outlet neck 51 and passage 53. The sewer waste drain connects to the combined outlet duct 55 which combines the flow from bowl outlet 50 and odor outlet neck 51.

Figure 3A:
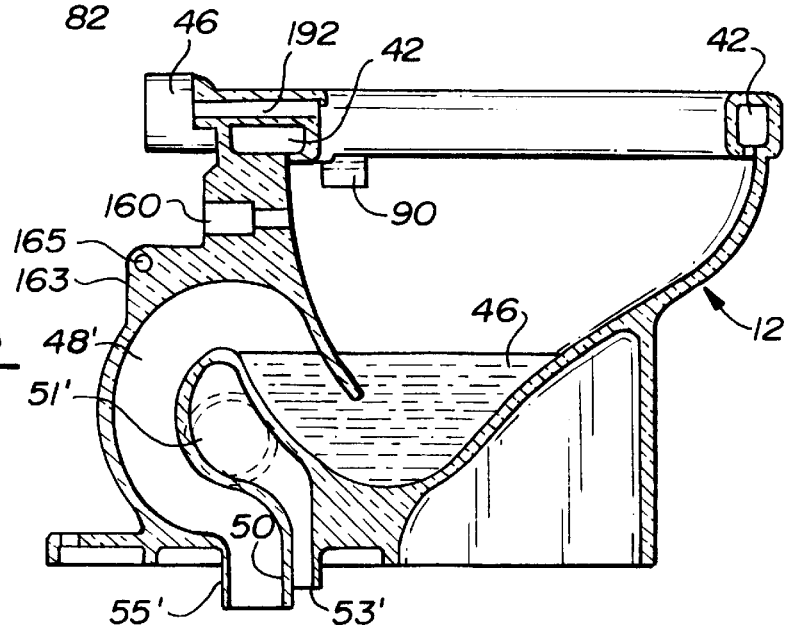
FIG. 3*a* is side elevation similar to FIG. 3 and illustrating a modified arrangement of the porcelain bowl in cross-section according to the present invention.
Figure 3:
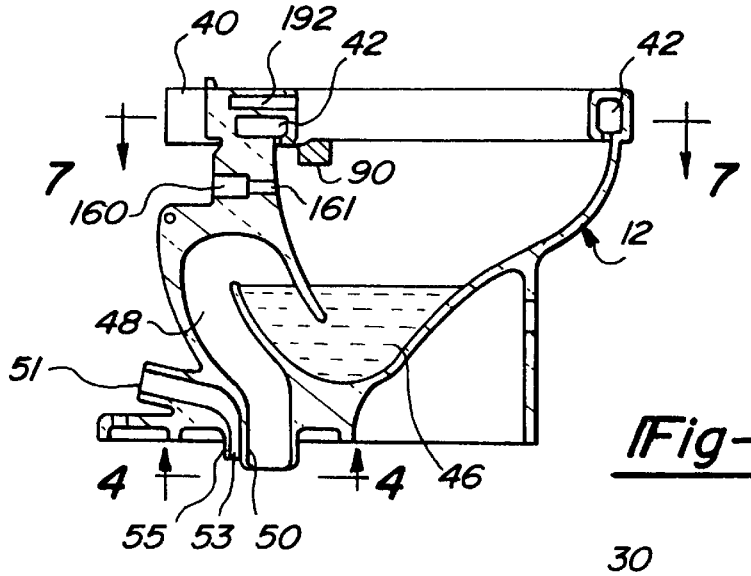
FIG. 3 is a side elevation of the porcelain bowl in cross-section.

Referring further to the modified arrangement of FIG. 3*a*, the siphoned discharge passage 48' is configured slightly differently than the passage 48 of FIG. 3 and so that the odor extraction outlet neck 51' extends in a central and horizontally arrayed fashion. The odor extraction outlet passage is illustrated at 53' and communicates the outlet neck 51' to combined outlet duct 55' of the sewer waste drain.

Figure 2A:
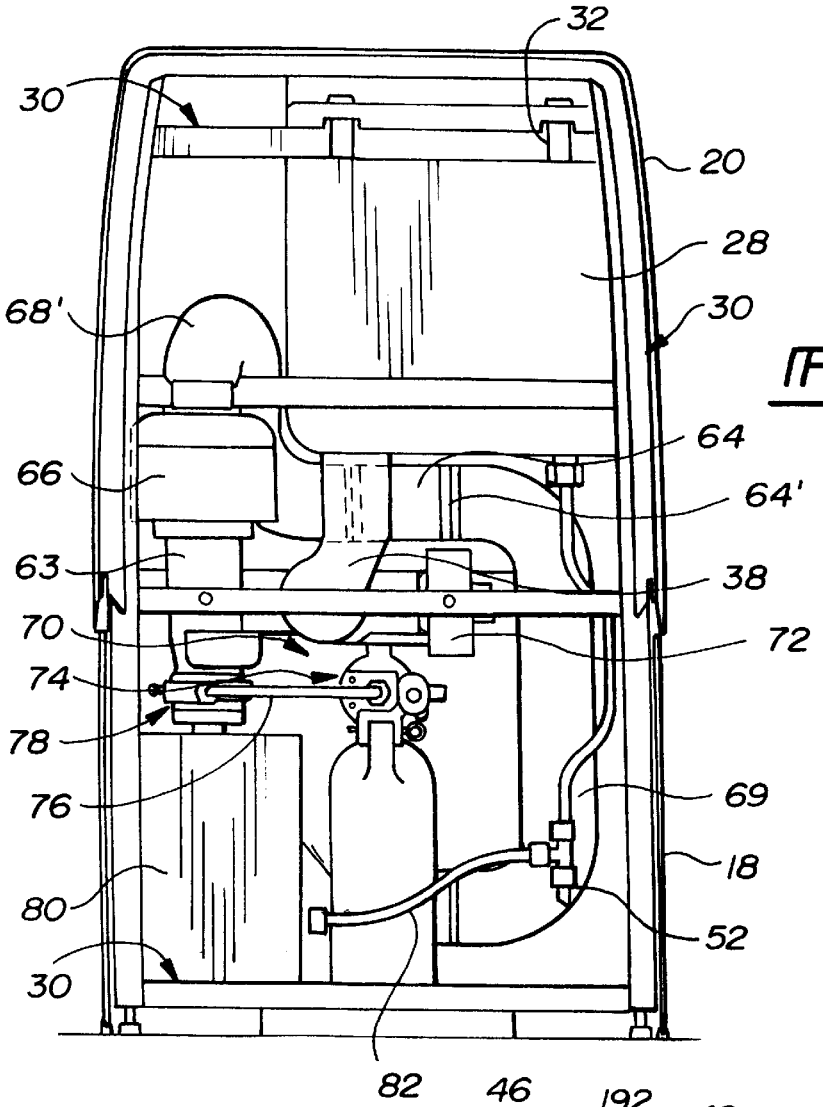
FIG. 2*a* is a rear elevational view similar to FIG. 2 and showing a modified arrangement of the relative location of many of the component parts according to the present invention.

Referring further to the modified view of FIG. 2*a*, the exhaust fan assembly is changed to an ordinary fan 64' which is built as a short round tube located between a first conduit portion 68' and a second interconnecting conduit portion 69 ranging between the odor extraction trap and valve assembly 66 and the outlet of the system. A connector tube 63 further replaces the exhaust fan assembly 64 as illustrated in FIG. 2 between the toilet bowl and the odor extraction trap valve in place of where the exhaust fan is located according to that figure.

Continuing to refer to FIG. 2, the auxiliary components also include a bidet type genital washing spray unit 70 with an air dryer 72. The spray unit 70 comprises a nozzle assembly 74, a flexible water line 76, a twin solenoid valve 78 and an electric water heater tank 80 which receives water through tube 82 from water supply pipe 52.

Figure 8:
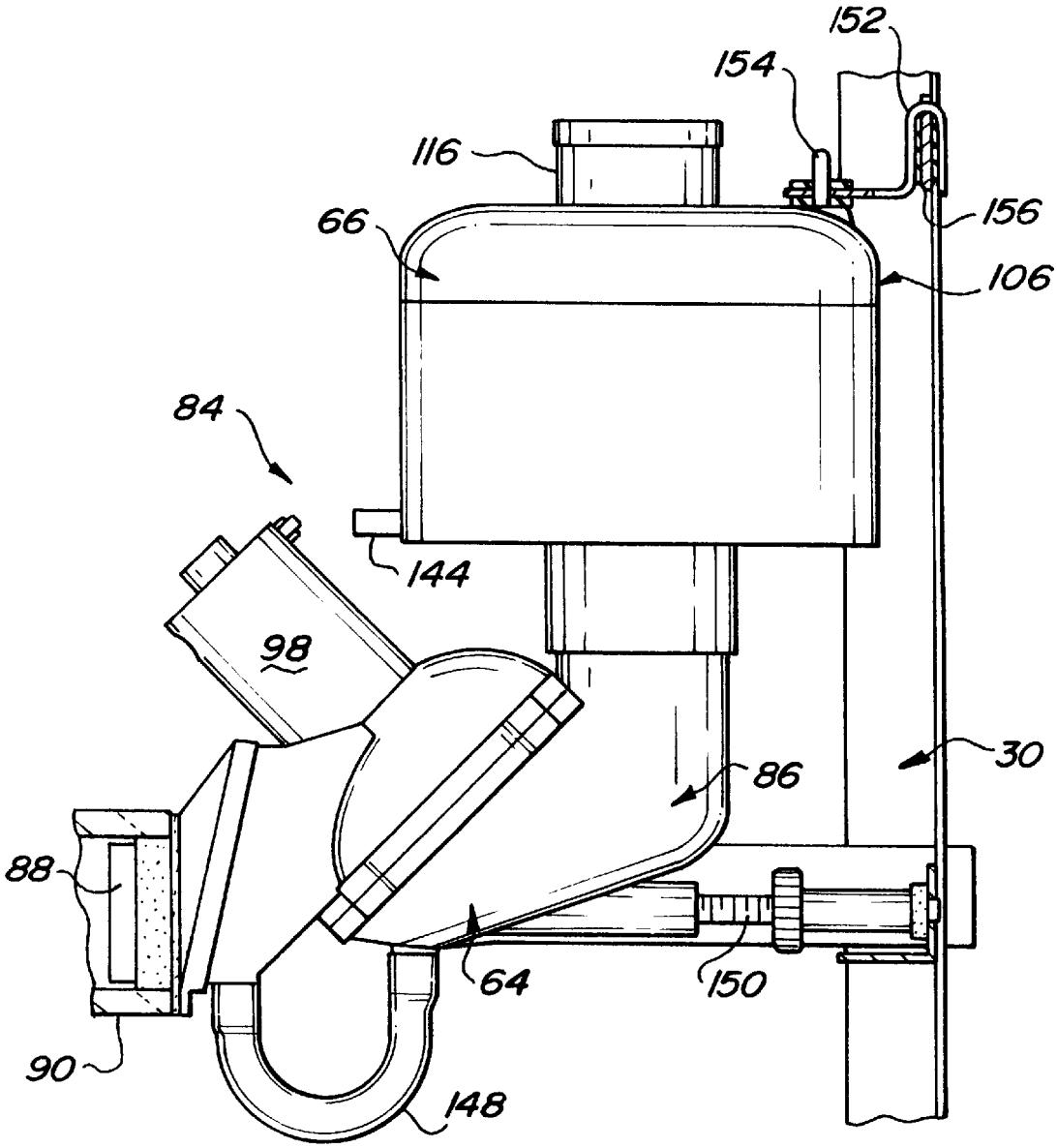
FIG. 8 is a side elevational view of the fan casing assembled to the odor extraction trap and valve housing.
Figure 10:
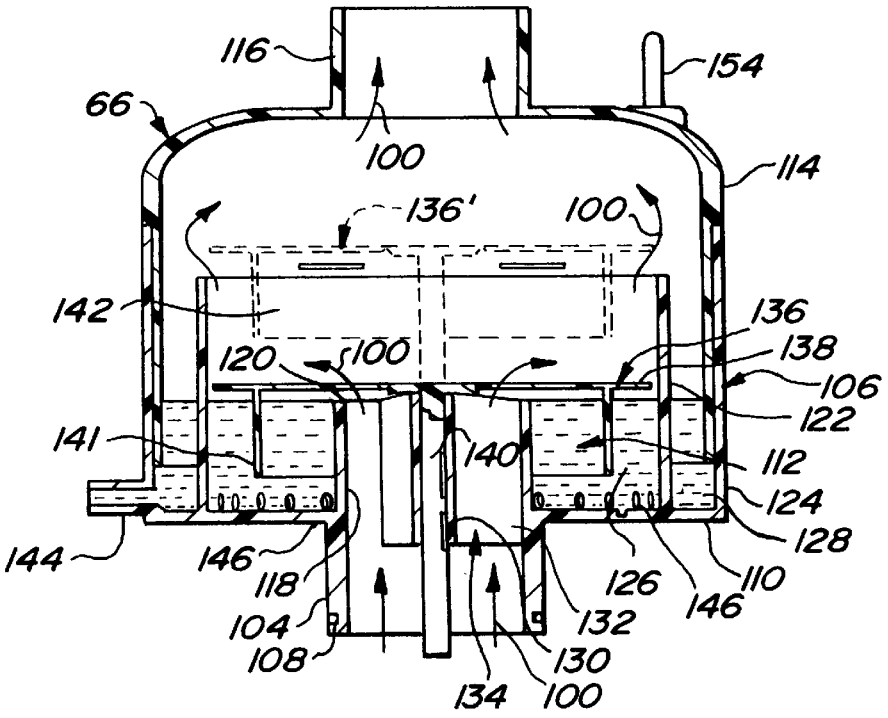
FIG. 10 is a cross-sectioned elevational view of the odor extraction trap and valve assembly.
Figure 9:
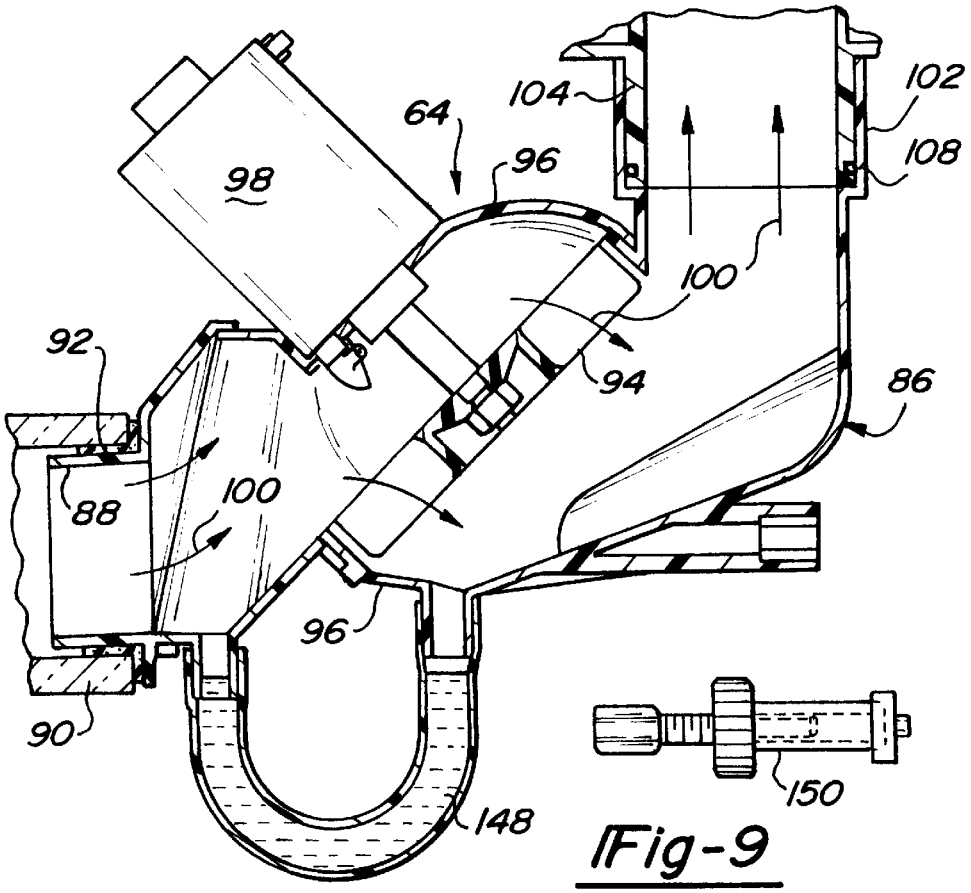
FIG. 9 is a cross-sectioned elevational view of the fan casing assembly.

The odor extraction or ventilating system 84 is shown in more detail in FIG. 8 and includes as its major components an exhaust fan assembly 64 shown in detail in FIG. 9 and an odor extraction trap and valve assembly 66 shown in detail in FIG. 10.

The exhaust fan assembly 64 includes a casing 86 having an air inlet 88 which is attached to the bowl air outlet 90 with a rubber seal 92. Exhaust fan 94 is contained in the intermediate casing portion 96 driven by fan motor 98 to deliver the odor containing air from the casing inlet 88 to the casing air outlet 102 in the direction of arrows 100.

The fan casing air outlet 102 is connected to the air inlet 104 of the housing 106 of the trap and valve assembly 66 using an O-ring seal 108. Housing 106 has a lower housing member 110 with an outer cylindrical wall 124 containing a valve sealing or trap water sump 112 and an upper housing member 114 containing air outlet 116. The lower housing member 110 has a vertically oriented tubular member 118 which is an extension of the housing air inlet 104 extending through the water sump 112 and terminating in an end which defame a water level overflow weir 120. The lower housing member 110 further has an upward extending tubular ring 122 concentric with tubular member 118 and outer cylindrical wall 124 dividing sump 112 into an inner annular valve sealing portion 126 and an outer annular water receiving portion 128. The air inlet 104 and tubular member 118 has a centrally located valve stem guide sleeve 130 affixed by spaced radial ribs 132 of a spider 134. A moving valve member 136 includes a planar circular top 138 with a centrally located vertically depending valve stem 140 movably supported in guide sleeve 130. A tubular valve skirt 141 concentric with valve stem 140 depends from top plate 138 extending into the inner portion 126 of sump 112 to form a water seal as the valve member is supported in its lower, closed, valve position by sleeve 130 with no air flow. When power is supplied to fan motor 98 to rotate fan 94, the air flow out of fan casing air outlet 102 and into trap housing air inlet 104, indicated by the arrows 100, lifts valve member 136 to the position shown in phantom at 136' with the valve top plate 138 and ring member 122 forming an air chamber 142, supporting the valve at a fixed height and allowing the air flow to exit the housing 106 through outlet 116 as shown by the arrows 100.

Figure 5:
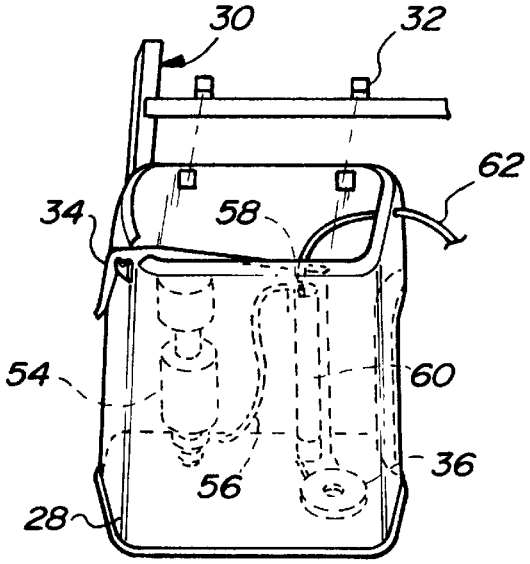
FIG. 5 is an exploded perspective view of the water tank as it attaches to steel framework at the rear of the toilet.

Fresh water is supplied to the sump 112 each time the toilet is flushed from the discharge of the flow control valve 54 through tubing 62 in the flushing mechanism shown in FIG. 5. Water enters the outer portion 128 of the sump 112 through water inlet 144. The water then flows evenly through small apertures 146 in the bottom of the tubular ring member 122 producing a good flow eliminating any sediment buildup into the inner annular portion 126 of the sump to overflow the overflow weir 120 passing downwardly through the housing air inlet 104 into the air outlet 102 of the fan casing 86. In order to avoid any interference with the fan 94 or carry back of the water with the air flow shown by arrows 100, a U-shaped water drain bypass conduit 148 is connected between the downstream side and the upstream side of the fan 94 around the intermediate casing portion 96 so that the water flows through the bypass into the casing outlet 88 and through the toilet bowl through bowl air outlet 90.

The odor ventilating system 84 is conveniently mounted by securing the casing 86 of the exhaust fan assembly 64 to the steel frame 30 at the rear of the toilet with the adjustable push rod 150, and by mounting the housing 106 of the odor trap and valve assembly 66 to the frame 30 with bracket 152 sliding over the mounting pin 154 on the housing 106 and clipping onto a cross member 156 of the frame 30.

Figure 6:
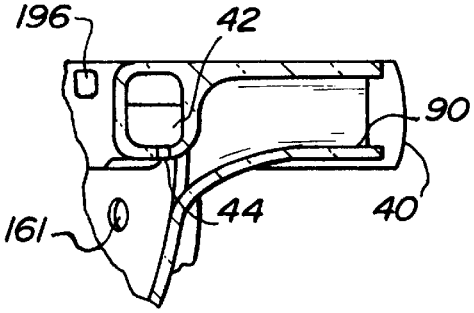
FIG. 6 is a partial elevational sectioned view taken along line 6—6 of FIG. 7.
Figure 7:
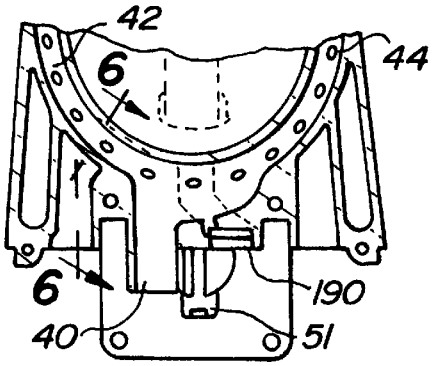
FIG. 7 is a partial plan sectional view taken along line 7—7 of FIG. 3.
Figure 10A:
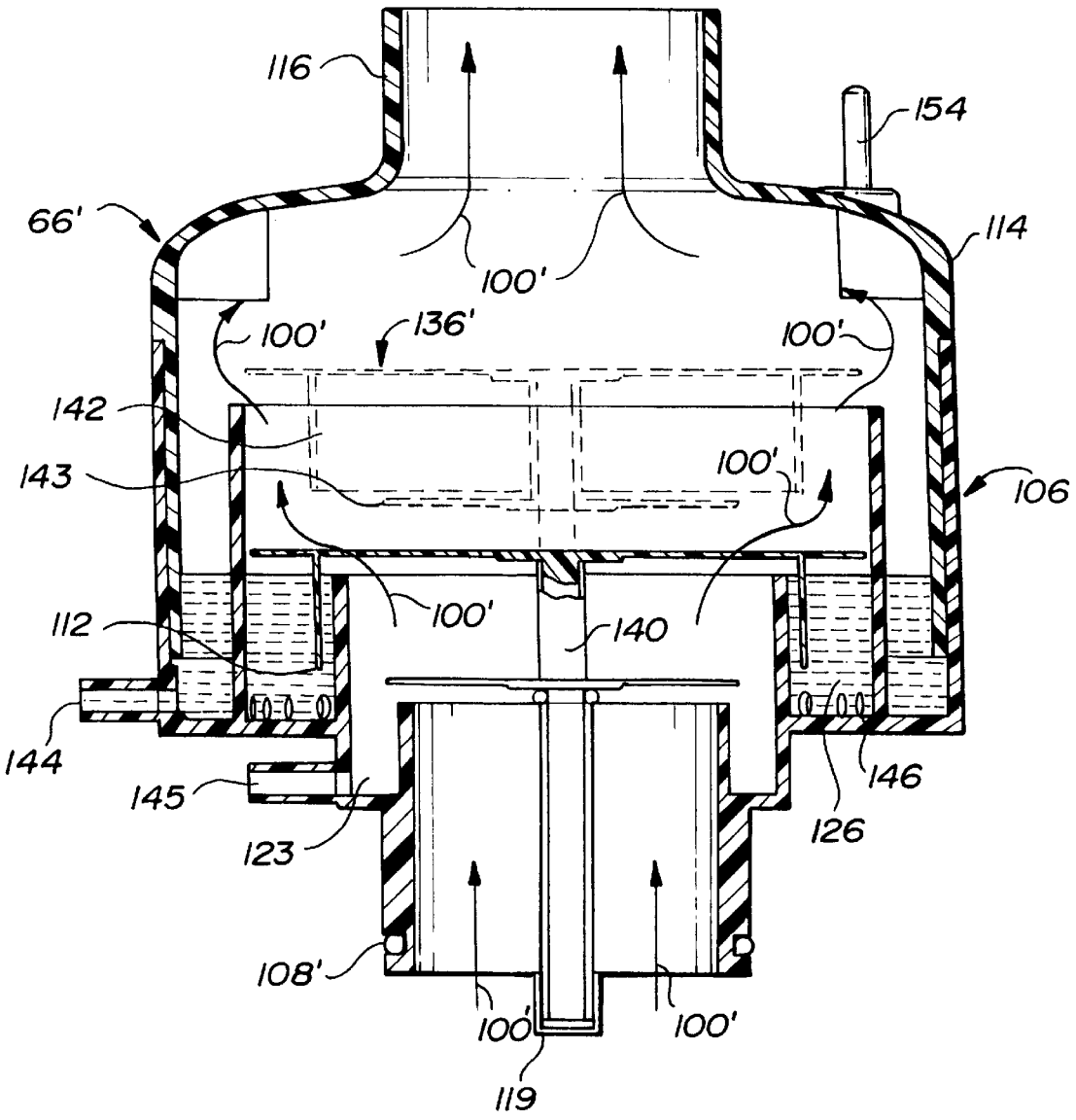
FIG. 10*a* is a view similar to that shown in FIG. 10 and illustrating a further modified odor extraction trap and valve assembly according to the present invention.

Referring to FIG. 10*a*, a modified assembly is illustrated at 66' of the odor extraction trap and valve assembly according to the present invention and includes a lower portion of the unit being reshaped so that a channel 123 is created for the purpose of collecting water overflowing from sump 112' and slowly diverting the water through outlet 145 and through a drainage hose (not shown) which is connected to the air outlet 90 (FIG. 6) of the bowl 12 when the water is discharged to the toilet bowl. An air spreader is provided at 143 and functions to channel the flowing air as is illustrated by reference arrows 100' and in the manner previously described. A shock absorber cap 119 is provided for establishing smoother functioning of the valve member 136 and eliminates the occurrence of a tapping noise when the valve is in the process of dropping to the down position. The remaining components are as substantially illustrated in FIG. 10.

Figure 10B:
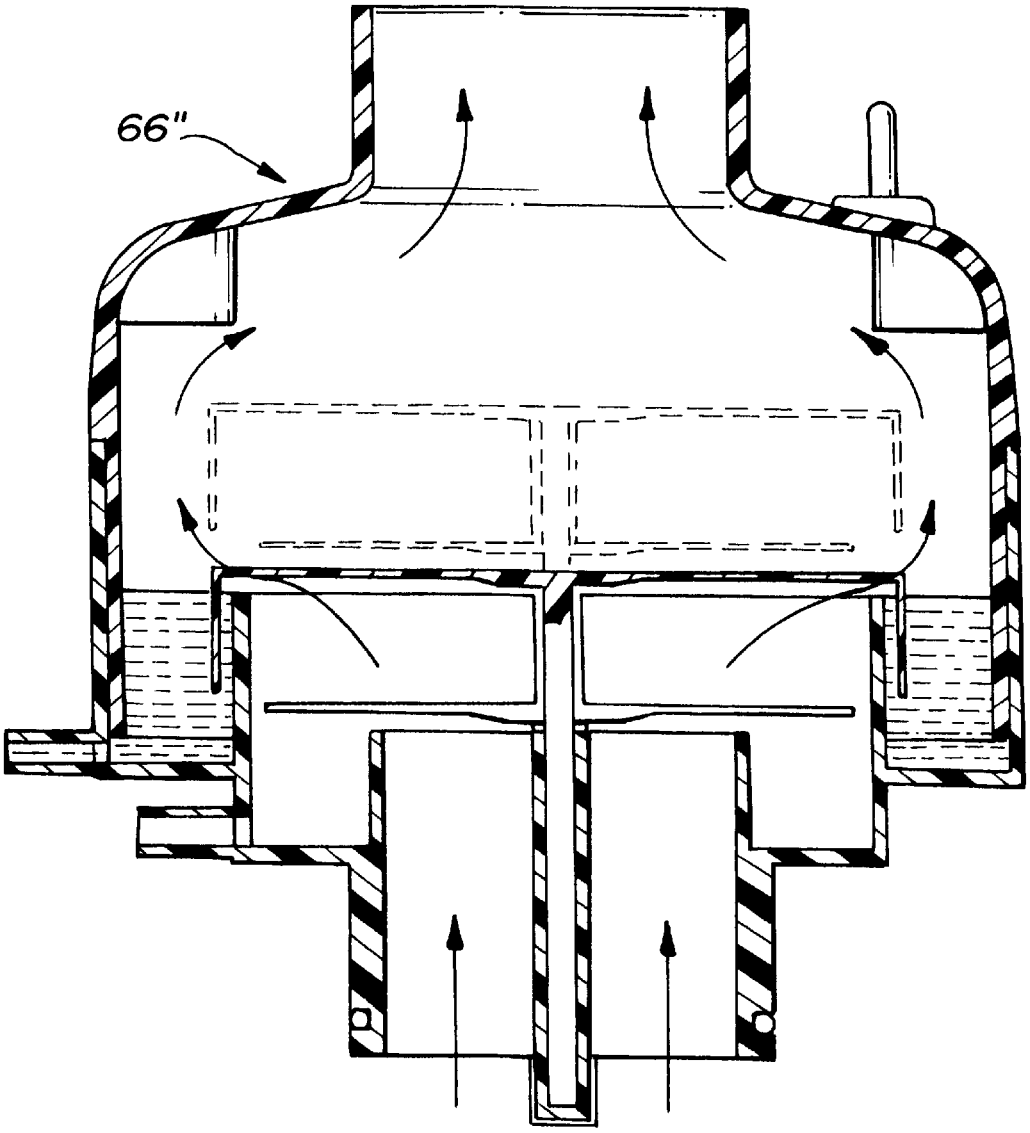
FIG. 10*b* is a view similar to that shown in FIG. 10 a and illustrating a yet further modified view of the odor extraction trap and valve assembly according to the present invention.

Referring further to FIG. 10*b*, a further slightly modified variation of the trap unit of FIG. 10*a* is illustrated at 66" and simply includes the features of the tubular ring member 122 and the edges from the planar circular top plate 138 being eliminated is opposed to what is illustrated in FIG. 10*a*. The remaining structure according to the further modified odor extraction trap and valve assembly operates substantially as has been previously described.

Figure 11:
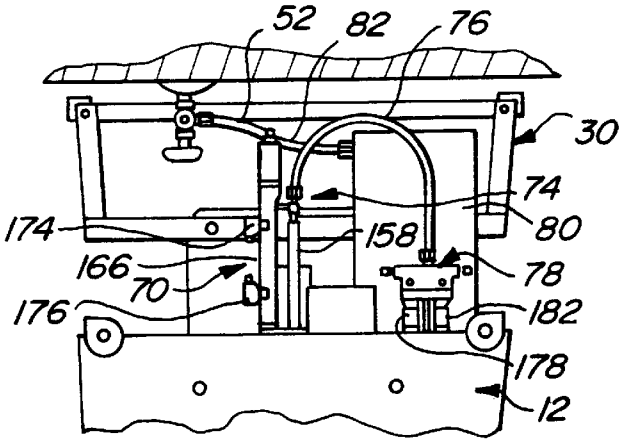
FIG. 11 is a plan view at the rear of the toilet showing the location of the spray nozzle pipe relative to the bowl.

Referring to FIG. 11, the bidet genital washing spray unit 70 has an electric warm water tank 80 mounted on the steel frame 30 and the nozzle tube 158 of its nozzle assembly 74 projecting into the seating aperture 160 and nozzle aperture 161 in the bowl 12. The nozzle assembly is also mounted and locked in place by a locking pin (not shown) to the hole 165 in a protruding portion 163 of FIG. 3*a* of the bowl 12.

Figure 12:
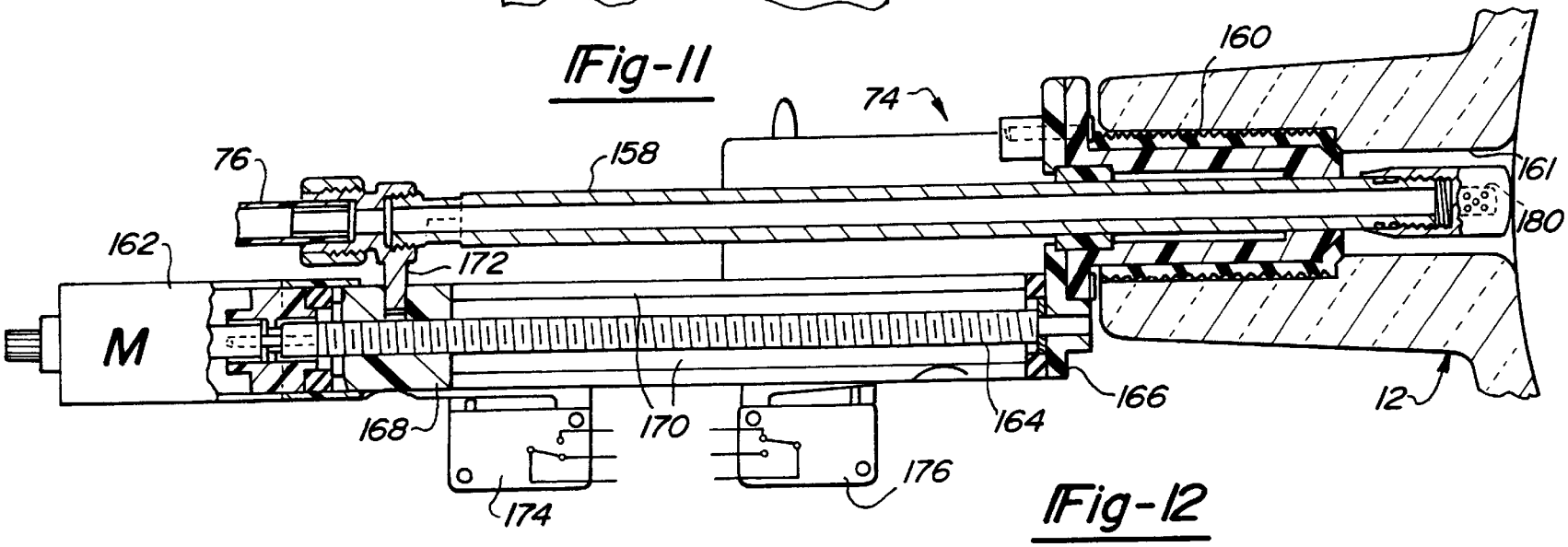
FIG. 12 is a plan cross-sectional view of the nozzle pipe assembly.

The details of the nozzle assembly 74 are shown in FIG. 12 wherein the electric motor 162 turns a threaded rod or screw 164 supported for rotation by a stationary frame member 166. The screw 164 engages a threaded block 168 which is restrained from rotation by guides 170. The threaded block 168 is attached to the end of the nozzle pipe 158 by connecting element 172. As the motor 162 rotates in one direction, the nozzle pipe 158 will be advanced into the toilet bowl 12 to a use position by the movement of block 168 along guides 170. When the motor is rotated in the opposite direction, the nozzle pipe 158 will be retracted out of the toilet to the retracted position shown in FIG. 12. In the retracted position of the nozzle pipe, a retracted position limit switch 174 will be activated by block 168 assuring that when power is supplied to the motor 162, it will rotate in a direction to advance the nozzle tube 158 into the bowl 12. When the nozzle pipe reaches its use position in the bowl 12, the use position limit switch 176 is actuated by the block 168 to shut off power to the nozzle pipe motor 162 and to supply power to twin solenoid valve 78 opening its low pressure valve 178 to supply warm water from water tank 80 through line 76 to the nozzle pipe 158 which exits through spray nozzle 180 as a gentle rinse spray. The user at his option may depress a switch, as will be explained later, to increase the water pressure to produce a brisk spray by supplying power to the twin solenoid valve 78 to open high pressure valve 182 in parallel with low pressure valve 178.

Figure 12A:
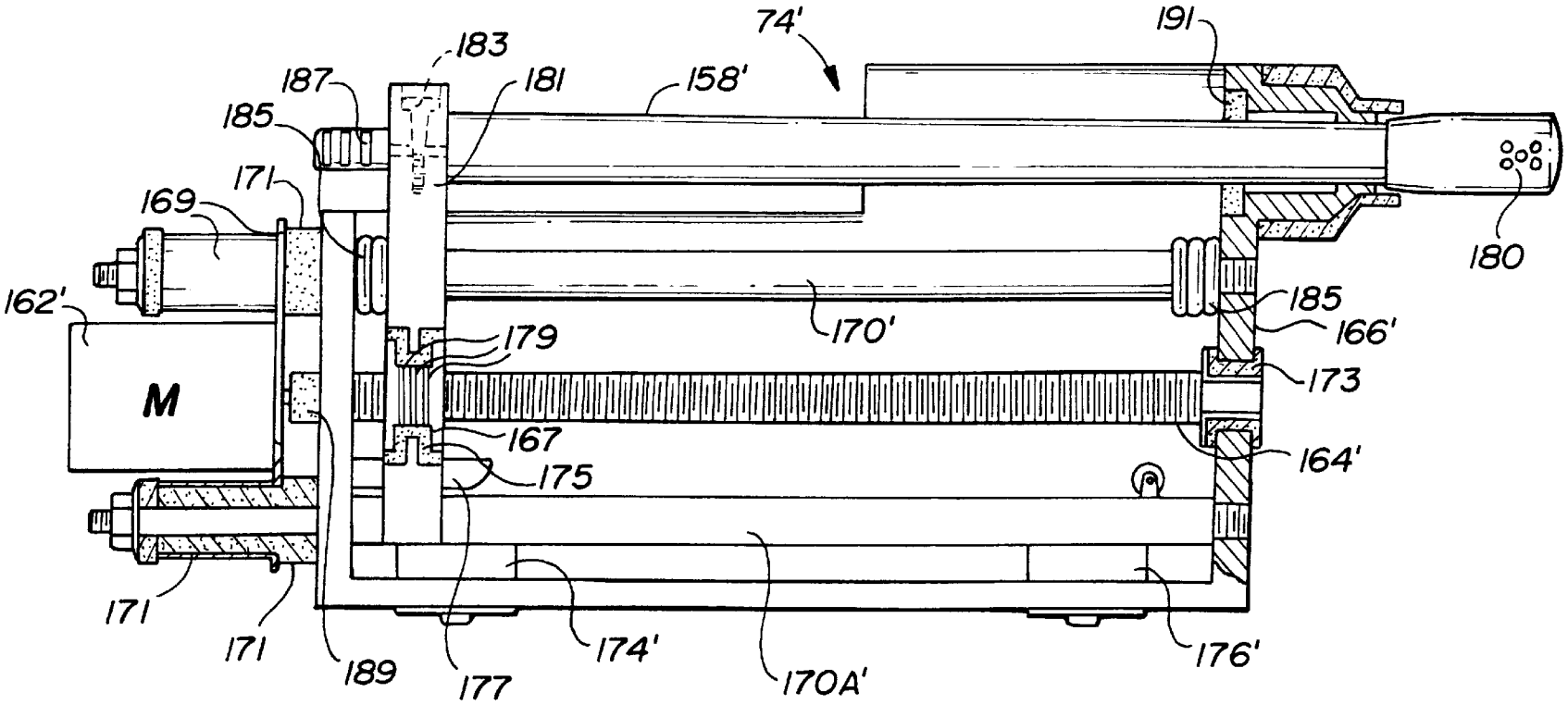
FIG. 12*a* is a view similar to that shown in FIG. 12 and further illustrating a modified version of the nozzle pipe assembly according to the present invention.

Referring now to FIG. 12*a*, a modified view of the nozzle assembly is illustrated at 74' wherein an electric motor 162' again turns a threaded rod or screw 164' supported for rotation by a stationary frame member 166'. The screw 164' engages an insert block-cooperative element 167 which further possesses individual steel springs 179 for cooperating directly with the threads on the threaded screw 164'. The electric motor 162', threaded screw 164' and insert block elements 166' are insulated from the rest of the components of the nozzle assembly. Acoustic absorbent rubber insulator 175 is provided for the reduction of noise and for protecting the steel springs 179. A retracted position limit switch 174' and a use position limit switch 176' are provided as well as a pusher element 177 for the limit switches. Nozzle pipe 158' is provided and, as the motor 162 is activated by a multi-function user switch, rotates in one direction, the nozzle pipe 158' will be advanced into the toilet bowl 12 to a use position by the movement of the insert block 167 along the rod 164'. When the motor is rotated in the opposite direction, the nozzle pipe 158' will be retracted out of the toilet to the retracted position shown in FIG. 12*a*. Limit switches 174 and 176 are used primarily to control travel of the nozzle pipe 158' in both retracted and use positions.

Additional features of the modified nozzle assembly 74' of FIG. 12*a* include an electric motor mounting bracket 169 and both acoustic absorbent rubber bushing 171 and acoustic absorbent rubber bushings with metal insert 173. Rod guides 170' and 170*a'* are also shown for supporting the arrangement of the threaded rod and nozzle pipe of the assembly 74' and provide for stable and smooth gliding movement of the nozzle pipe.

Slide guide 181 mounts one end of the rod and nozzle pipe and includes a locking screw 183 for locking the slid guide 181 with the nozzle pipe 158'. Energy absorbing rubber rings 185 are provided at the other end of the rod guide 170' and are supported by an opposing end 166' of the stationary support member. Hose fitting connectors are provided at 187 as well as rubber or soft plastic connectors 189 with which to connect the electric motor 162 with the threaded rod 164'. A felt seal 191 is also provided for receiving a nozzle pipe lubricant and for providing properly channeled support of the nozzle pipe 158'.

Figure 13:
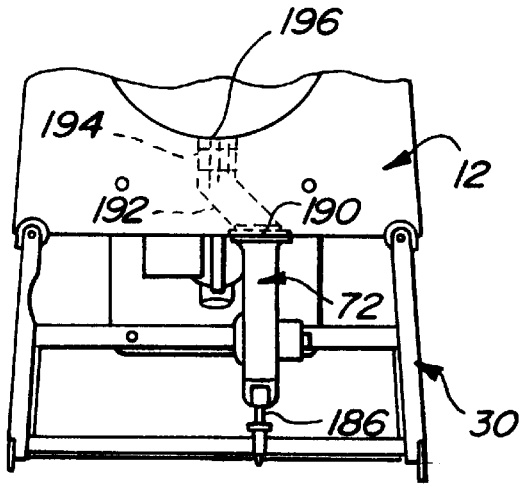
FIG. 13 is a plan view at the rear of the toilet showing the location of the dryer relative to the toilet bowl.
Figure 14:
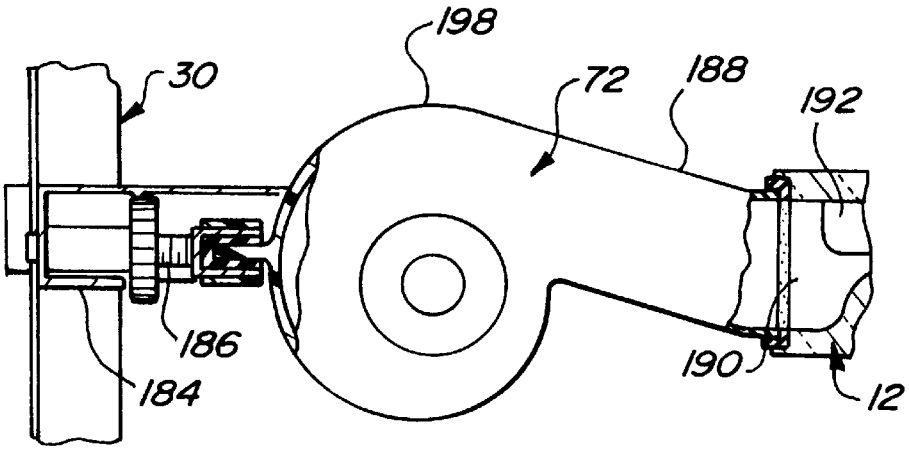
FIG. 14 is an elevational view showing the mounting of the dryer fan.
Figure 15:
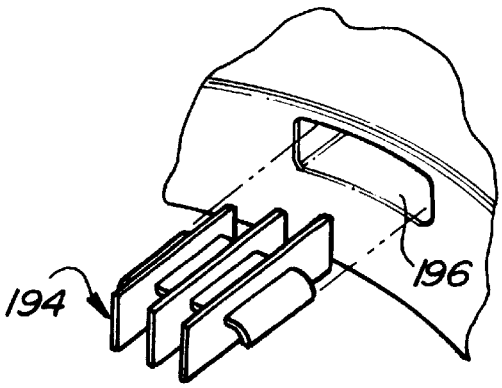
FIG. 15 is a partial perspective view of a portion of the bowl showing the warm dryer air inlet: grill.

As seen in FIGS. 13–15, the warm air dryer 72 is mounted by being pressed between the cross member 184 of frame 30 and the bowl 12 by the adjustable push rod 186 with the outlet neck 188 of the dryer 72 being in registry with the bowl aperture 190 to convey the heated air through the dryer duct 192 and grill 194 into the bowl 12 through air inlet aperture 196. The air dryer 72 is of a conventional blow hair dryer having a motor, fan and an electric heater, not shown, within its casing 198.

Figure 16:
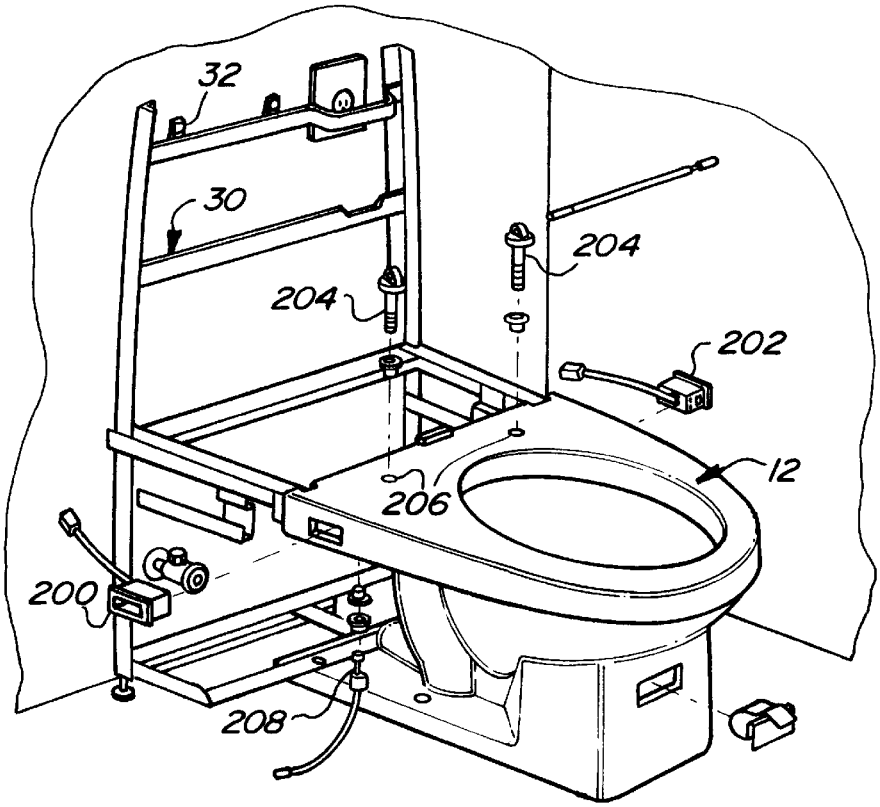
FIG. 16 is a perspective view of the bowl and the steel framework for supporting the operating elements.

Referring to FIG. 16, the toilet bowl 12 is equipped with a right hand, user operated, two position on-off switch 200 located on the right hand side of the bowl and a left hand, user operated, two position multifunction switch 202 located on the left hand side of the bowl. The toilet seat bolts 204 which mount the toilet seat 14 and toilet seat cover 16 through hinges, see FIG. 1, pass through apertures 206 in the bowl and are arranged to move vertically a small distance to turn on enabling seat switches 208, only one of which is shown, when the user sits on the seat 14. The two user switches 200 and 202 and the seat switches 208 along with the nozzle pipe limit switches 174 and 176 shown in FIGS. 11 and 12 constitute the key operating elements of the toilet switch control system shown schematically in FIG. 19 with FIGS. 17*a* and 17*b* and FIGS. 18*a*, 18*b*, 18*c* and 18*d* showing the operating positions of the user switches 200 and 202 respectively.

Figure 18A:
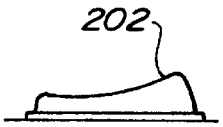
FIGS. 18*a–d* are switch position views of the two position multifunction user switch.
Figure 18B:
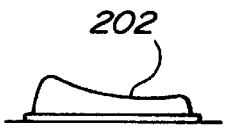
Figure 18C:
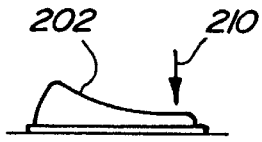
Figure 18D:
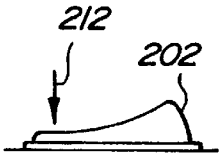
Figure 19:
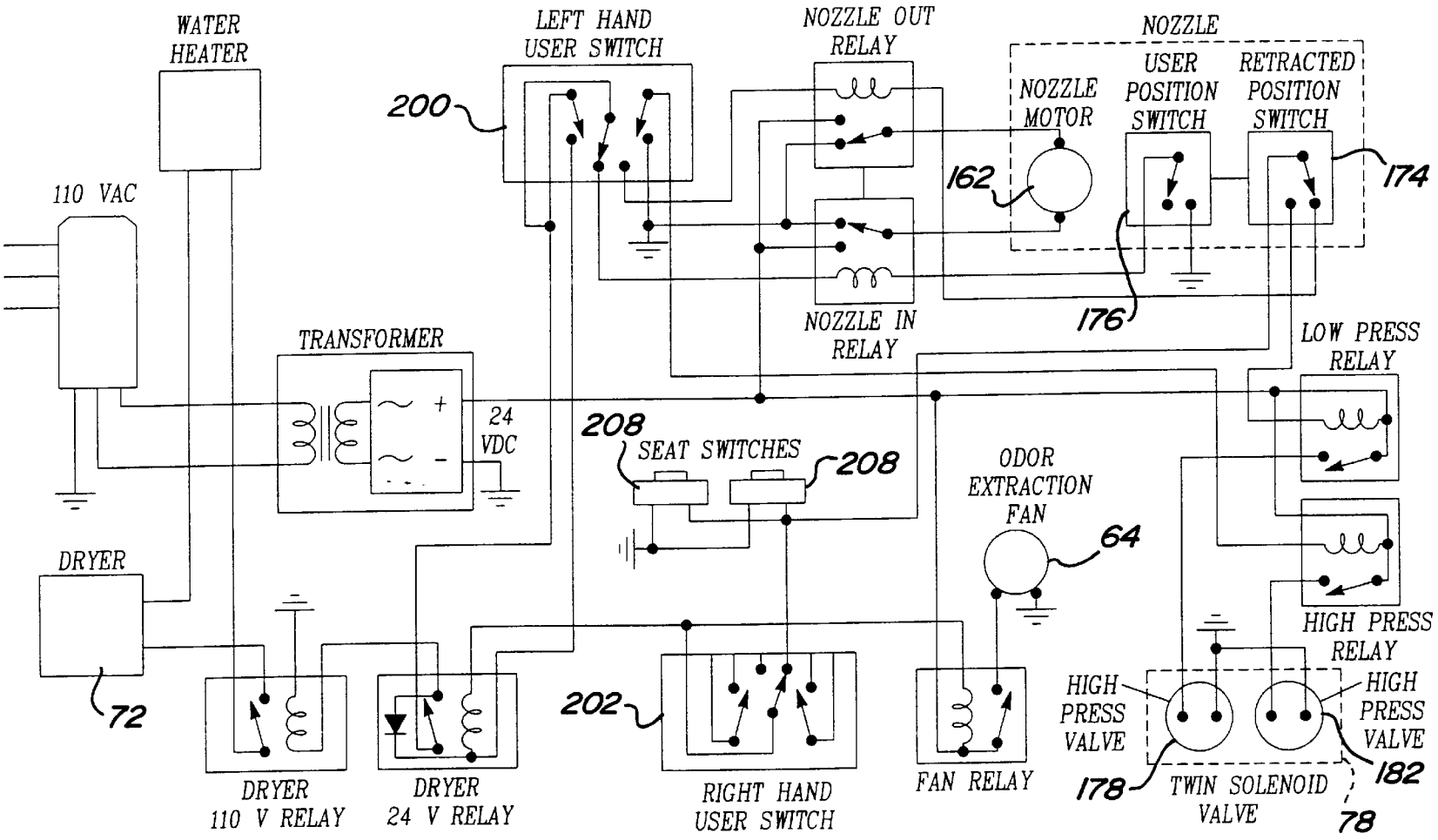
FIG. 19 is a wiring schematic of the switch control system of the invention.

Referring to FIGS. 17–19, when the user sits on the toilet seat 14, the enabling switches 208 are closed which allows the odor extraction fan 64, the air dryer 72 and the nozzle pipe motor 162 to operate with the other switches; that is, the other switches will not operate these items unless the enabling switches 208 are closed by the user sitting on the toilet seat; likewise, if the user gets off the toilet seat, the system will shut down.

Figure 17A:
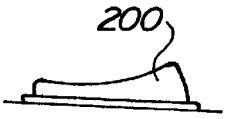
FIG. 17*a* is a view of the two position user on-off switch in the off position.
Figure 17B:
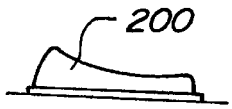
FIG. 17*b* is a view of the two position user on-off switch in the on position.

With the user seated, when he depresses and releases the right hand onoff switch 200 moving the switch from the position of FIG. 17*a* to the position of 17*b*, the odor extraction fan 64 will operate, and the dryer 72 can also be operated later by the user by using the left hand switch 202. When the user wishes to use the spray rinse, he depresses and releases the left hand multifunction user switch 202, moving the switch from the position of 18*a* to the position of 18*b*; this supplies power to the nozzle pipe motor 162 which moves the nozzle pipe 158 from its retracted position outside the toilet bowl to its use position inside the toilet bowl, opening the retracted position limit switch 174. When the nozzle pipe reaches the use position, the use position limit switch 176 will close, turning off the power to the nozzle pipe motor 162 and supplying power to the twin solenoid valve 78 to open the low pressure valve 178 to supply a gentle spray of warm water through the nozzle pipe. If the user wishes to have a stronger or more brisk spray, he can depress and hold the left hand user switch in its on position as shown in FIG. 18*c* with the arrow 210 indicating that the switch 202 has to be pushed again in the on position and held; this opens the high pressure valve 182 in parallel with the low pressure valve 178. When the switch 202 is released in the on position, the high pressure valve 182 will close and the spray will return to the low pressure gentle spray.

When the user is finished with the spray, he flips switch 202 back to position shown in FIG. 18*a*. This position supplies power to the nozzle pipe motor 162, to retract the nozzle pipe 158. When the nozzle pipe retracts, the nozzle switch 176 cuts off the low pressure valve 178 and the water stops spraying. When the nozzle pipe reaches the retracted position, the limit switch 174 shuts off motor 162 in the retracted position. If the user wishes to use the warm air dryer 72, he presses and releases switch 202 as indicated by the arrow 212 in FIG. 18*d*, which turns on the dryer 72. When he is finished with the dryer, the user shuts off the dryer by simply getting up and releasing pressure from the seat switches 208. This opens up the circuit on the 24 volt dryer relay, which then shuts off the dryer. Also, the dryer could be turned off by using the right-hand switch 200, which would require it to be flipped to the off position FIG. 17*a*.

Figure 4:
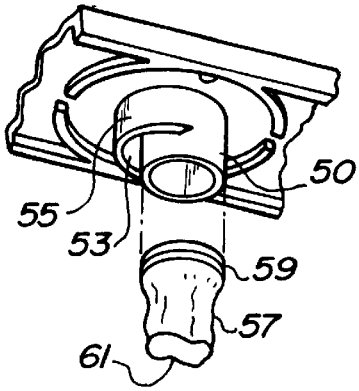
FIG. 4 is an exploded perspective view of the bottom of the bowl taken along line 4—4 of FIG. 3 with a water saving sleeve being attached.

Referring to FIG. 4, in a preferred form of the invention, a water saving device in the form of a flexible sleeve 57 of soft rubber or fabric has been slid over the bowl outlet 50 and is retained there by a clamp band 59. The sleeve has a free end 61 which extends into the sewage waste drain so that when the flushing mechanism is operated, water will flow as a stream to the siphoned outlet 50 and into the sleeve 57 with the sleeve clinging to and conforming to the stream preventing air from getting into the outlet, creating a greater pressure differential from the toilet bowl 12 to the waste drain thereby reducing flushing time and saving water.

Figure 20:
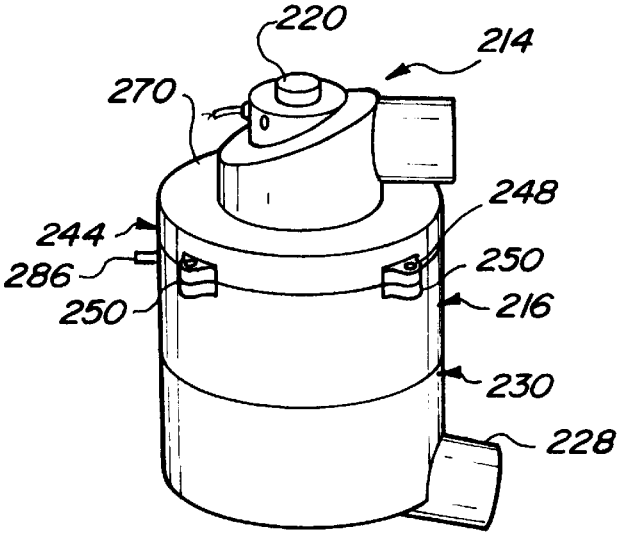
FIG. 20 is a perspective view of a combined water trap valve and fan for odor extraction.
Figure 22:
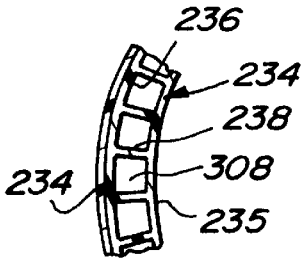
FIG. 22 is a partial sectional view taken along line 22—22 of FIG. 21.
Figure 21:
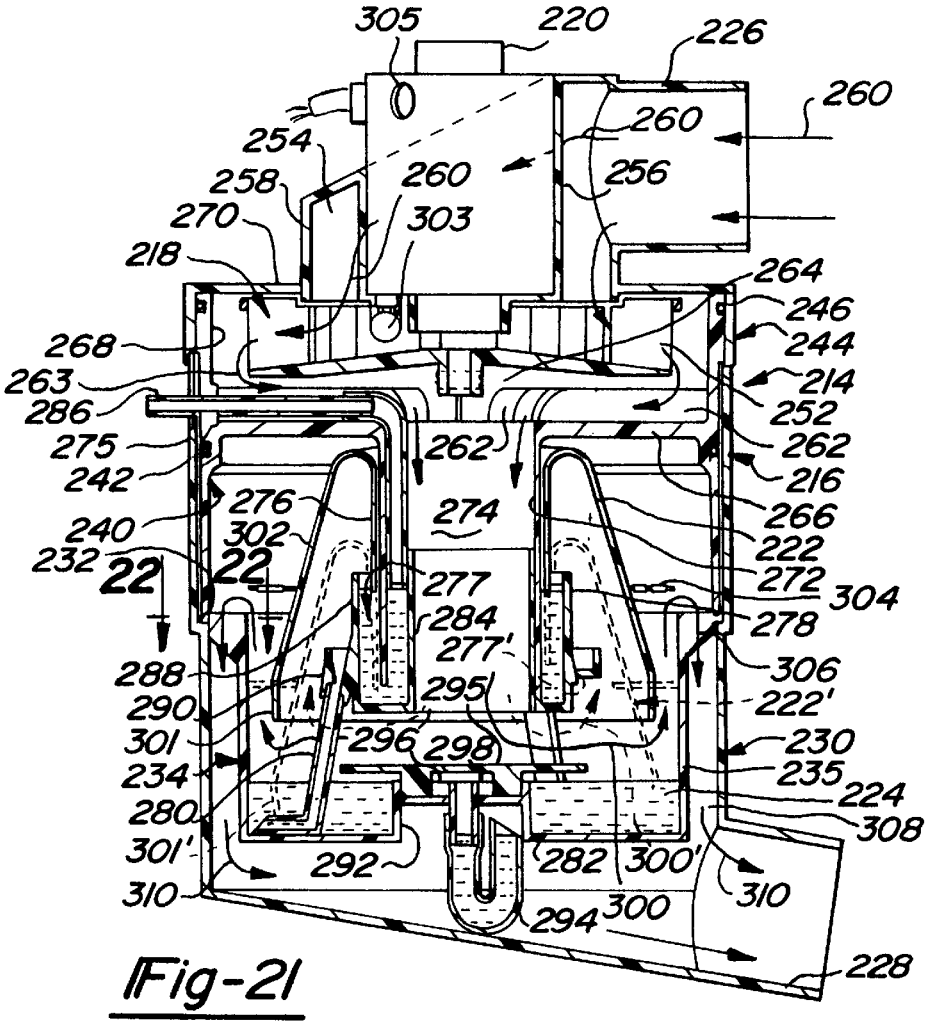
FIG. 21 is a cross-sectional elevational view of the combined water trap and fan of FIG. 20.

In another embodiment of the invention, shown in FIGS. 20–22, the ventilating or odor extraction system 84 of FIG. 8 employing a separate exhaust fan assembly 64 shown in FIG. 9 and a separate trap and valve assembly 66 shown in FIG. 10 is replaced by an integral, unitary or combined unit 214 having a single housing 216 containing the exhaust fan 218 and its motor 220 and the moving valve member 222 with its water trap sump 224.

In the integral unit 214 the fan 218 is located at the top with the valve 222 and sump 224 located at the bottom, in a reverse order to the assembled system 84 of FIG. 8, but the air inlet 226 is connected to bowl air outlet 90 and the air outlet 228 is normally connected to the bowl outlet neck 51 as in the assembled system 84, and the air pressure is used to lift the valve 222 to an open position as the valve 136 in the FIG. 8 system is lifted to an open position.

The housing 216 has a bottom housing member 230 with a cylindrical outer wall having an offset to form an inner ledge 232 to support a lower water container 234 with the sump 224 located at its bottom. The lower water container 234 has an outer cylindrical flange 236 supported by circumferentially spaced ribs 238 extending outwardly from outer cylindrical wall 235. The flange 236 seats on the inner ledge 232 to support the container 234.

An inner housing member 240 seats in the upper end of bottom housing member 230 against the flange 236 being sealed to the bottom housing member 230 by O-ring 242.

A top housing member 244 slips over the top of inner housing member 240 with an O-ring seal 246 and is attached to the bottom housing member 230 by screw fasteners 248 through fastening lugs 250. The top housing member 244 acts as the fan casing 86 in the embodiment of FIGS. 8–10, containing the exhaust fan 218 and the fan motor 220. The fan has an annular array of blades 252 which draws the air being exhausted from the bowl outlet 90 through housing inlet 226 and through the annular space 254 between inner and outer wall portions 256 and 258 of the top housing member 244, as shown by the arrows 260 in FIG. 21. The air passes radially outward between the blades 252 and is straightened and directed radially inward by baffles 262 located at the bottom of fan chamber 264 on divider wall 266 of the inner housing member 240. This radially inward air flow is shown by arrows 263. The fan chamber 264 is formed by divider wall 266 and the outer cylindrical wall portion 268 of inner housing member 240 acting with the annular wall portion 270 of the top housing member 244.

The inner housing member 240 is also formed with a central tubular wall portion 272 which internally defines an axial air duct 274 and externally provides a cylindrical sliding surface for the inner tubular portion 276 of moving valve member 222. The downward air flow through air duct 274 is shown by arrows 275.

An upper annular water container 278 is supported by three equally spaced tubular legs 280, only one of which is seen in FIG. 21, on the bottom wall 282 of the lower water container 234. The inner tubular wall 284 of the upper water container 278 slides into the central tubular wall portion 272 of the inner housing member 240 to form a downward continuation of the axial air duct 274. Fresh water is supplied to the upper water container 278 by the tube 286 each time the toilet is flushed from the discharge of the flow control valve 54 through tubing 62 in the flushing mechanism shown in FIG. 5 in the same manner as fresh water is supplied to the sump 112 of the odor control system 84 of FIG. 8. Water overflows the outer tubular wall 288 of the upper water container 278 and passes to circumferential trough 290 for delivery of fresh water to sump 224 through tubular legs 280. The lower water container 234 has a central portion 296 defined by tubular wall portion 292 to which a U-shaped water trap outlet 294 is attached. Fresh water delivered to sump 224 will overflow tubular wall portion 292 into central portion 296 and then through the water trap outlet 294, to the outlet duct 228. A splash guard baffle plate 295 is supported by ribs 298 in the central portion 296 of the lower water tank 234 to deflect the downward air flow upwardly as shown by arrows 300 between the outer wall 302 of valve 222 and the wall 235 of the lower water tank 234.

With no air flow the valve member 222 is in its sealing position shown in phantom at 222' in FIG. 21. The lower portion 301 of the outer valve wall 302 is immersed in sump 224 as shown at 301',and the lower end 277 of the valve inner wall portion 276 will be close to the bottom of the upper water container 278 as shown in phantom at 277'. This closed position prevents any backup of sewer gases through air outlet 228.

When the motor 220 is turned on, the downward air flow 275 will be directed upwardly by the splash guard 295 to push against the inside of valve member 222 as shown by arrows 300' inside the lower position of the valve shown at 222'. This will lift the valve member 222 so that the lower end 301 of the outer valve wall will move upwardly out of the sump 224 as the inner tubular portion 276 of the valve slides upwardly in contact with the central tubular wall portion 272 of the inner housing member 240 in the upper water container 278. This air then passing upwardly as shown by arrows 300 between the outer wall 302 of the valve member 222 and the wall 235 of the lower tank 234 will push against the collar or radial baffle 304 extending outwardly from the outer valve wall 302 to further lift the valve member 222 to an equilibrium position shown in full line in FIG. 21 where the air will be deflected downwardly by the baffle 304 as shown by the arrows 306 through the annular passage 308 between the outer cylindrical wall 235 of the lower water container 234 and the wall of the bottom housing member 230 into the air outlet 228 as shown by the arrows 310.

The fan motor 220 receives cooling by the air flow between the inner and outer wall portions 256 and 258 of the top housing member 244. To enhance cooling, a flapper valve 303 is located inside the fan scroll attached to the bottom of the motor housing defined by the inner wall portion 258 of the top housing member 244. When the fan is operating, the air flow shown by arrows 260 will open the flapper valve 303 to cause additional cooling air to enter the motor housing through the air inlet 305 to be pulled along with the general air flow.

I claim:

1. A multifunction toilet including a toilet bowl with a flushing ring manifold adjacent the top of said bowl and a water trap seal between said bowl and a siphon outlet to a sewage waste drain; a water supply tank incorporating a flushing mechanism with a valve controlled outlet to said flushing ring manifold and a level control including an overflow tube in communication with said bowl; and a ventilating system for withdrawing gases from said bowl for odor control comprising:

an fan connected to an air outlet of said toilet bowl;

an odor extraction trap and valve assembly connected to said fan and to a gas disposal outlet, said odor extraction trap and valve assembly includes a housing having an air inlet connected to said fan, said air inlet including a vertically oriented tubular member extending upwardly into said housing through said water sump terminating in an end defining a water level overflow weir and the valve of said odor extraction trap and valve assembly comprises a valve stem guide sleeve centrally located in said tubular member, and said moving valve member includes a circular top plate having a vertically depending valve stem movably supported in said guide sleeve and a tubular valve skirt depending from said top plate so as to extend into said sump to form a water seal; whereby when said fan is operating, lifting said inlet valve, said tubular valve skirt will be lifted above said water sump creating said air flow path;

said assembly having a water sump and a valve with a moving member extending into said sump in a closed position of said valve to prevent backflow of gas from said gas disposal outlet; and wherein when said fan is operating creating an airflow from said bowl air outlet, the air flow will lift said moving valve member to an open valve position creating an air flow path above said water sump, and when said fan is turned off, said moving valve member will return to its closed position.

2. The multifunction toilet according to claim 1 wherein water is supplied to said sump each time the toilet is flushed from said flushing mechanism.

3. The multifunction toilet according to claim 1 wherein said fan has a casing with an air inlet and an air outlet, said air inlet being connected to said toilet bowl air outlet, and said air outlet being connected to the air inlet of said housing and wherein water is supplied to said sump each time the toilet is flushed from said flushing mechanism creating an overflow of water over said overflow weir out of said housing inlet and through said fan casing from said casing air outlet to said casing air inlet and into said toilet bowl through the air outlet in said toilet bowl.

4. The multifunction toilet according to claim 3 wherein said fan casing has a water drain bypass conduit with one end connected to said casing between said casing air inlet and said fan and the other end of said bypass is connected to said casing between said fan and said casing outlet, and wherein said overflow of water passes through said bypass.

5. The multifunction toilet according to claim 1 wherein said fan and said odor extraction trap and valve assembly are located within a housing with said fan being located between a first conduit section and a second interconnecting conduit section ranging between said odor extraction trap and valve assembly and said outlet at the bottom of said housing.

6. The multifunction toilet according to claim 1 wherein said odor extraction trap and valve assembly further comprises a horizontally disposed channel for redirecting water from said water sump through said water outlet.

7. The multifunction toilet according to claim 6, further comprising a shock absorber cap mounted to a bottom end of said vertically oriented tubular member for creating smoother function of said valve member.

8. In a multifunction toilet including a toilet bowl with a flushing ring manifold adjacent the top of said bowl and a water trap seal between said bowl and a siphon outlet to a sewage waste drain, a toilet seat mounted to the top of said bowl; a water supply tank incorporating a flushing mechanism with a valve control outlet to said flushing ring manifold and a level control including an overflow tube in communication with said bowl; the improvement comprising the following auxiliary components:

a fan connected to an air outlet in said toilet bowl for withdrawing gases from said bowl for odor control;

air conduits located on both sides of said fan and to said sewage waste drain downstream of said bowl water trap seal;

a control system including the following elements:

an enabling switch connected to said fan and activated by a user sitting on said toilet seat;

a user on-off switch connected to said fan;

wherein said fan is turned on only when a user is sitting on said toilet seat and the user switches said user on-off switch to an on position;

said auxiliary components further including a nozzle pipe;

an electric motor for advancing said nozzle pipe into said bowl from a retracted position to a use position and for retracting said nozzle pipe from said bowl from said use position to said retracted position;

a warm water tank connected to said nozzle pipe with an electrically operated valve; and wherein said control system includes:

a retracted position limit switch;

a use position limit switch;

a pusher element for said limit switches;

wherein when the user is sitting on said toilet seat, and he switches said multi-function switch from an off position to an on position, power will be supplied to said motor, advancing said nozzle pipe into said bowl, opening said retracted position limit switch, and when the nozzle pipe reaches its use position, said use position limit switch will be closed stopping said motor and opening said electrically operated valve to supply warm water through said nozzle pipe to provide a rinse spray; and wherein when the user switches said multi-function switch to an off position, said electrically operated valve will be closed, shutting of said spray and power will be supplied to said motor retracting said nozzle pipe from said bowl, and when said nozzle pipe reaches its retracted position, said retracted position limit switch will be closed shutting off said motor.

9. The multi-function toilet according to claim 8, wherein said electrically operated valve is a twin solenoid valve including a low pressure valve and a high pressure valve connected in parallel between said warm water tank and said nozzle pipe; and wherein when warm water is being supplied through said nozzle pipe providing a rinse spray, a gentle low pressure spray is produced by the water passing through the low pressure valve, and the user can increase the pressure to produce a brisk spray be depressing and holding the multifunction user switch in its on position, opening said high pressure valve.

10. The multi-function toilet according to claim 8, further comprising a slide guard mounted at a first end of said nozzle pipe and a stationary frame member at a second end of said nozzle pipe, a threaded rod being received at opposite ends rotatably through said slide guard and securably to said stationary frame member and in generally parallel arrangement to said nozzle pipe.

11. The multi-function toilet according to claim 10, further comprising an insert block-cooperative with said threaded rod connection to said slide guard, said insert block further including individual steel springs for cooperating with said threads on said rod.

12. The multi-function toilet according to claim 11, further comprising an acoustic absorbent rubber bushing with metal insert securing said threaded rod to said stationary frame member.

13. The multi-function toilet according to claim 12, further comprising a pair of parallel extending and spaced apart rod guides secured between said slide guard and stationary frame member.

* * * * *

UNITED STATES PATENT AND TRADEMARK OFFICE

CERTIFICATE OF CORRECTION

PATENT NO. : 6,073,275
APPLICATION NO. : 09/124696
DATED : June 13, 2000
INVENTOR(S) : Stanislaw Klopocinski It is certified that error appears in the above-identified patent and that said Letters Patent is hereby corrected as shown below:

Column 1, line 7 – After “toilet” insert --,--
Column 2, line 64 – After “position” insert --.--
Column 4, line 47 – Replace “drawing” with --drawings--
Column 4, line 51 – Replace “rear” levational” with --rear elevational--
Column 4, line 60 – Before “side” insert --a--
Column 5, line 15 – Replace “10 a” with --10a--
Column 5, line 31 – Replace “inlet:” with --inlet--
Column 6, line 65 – Replace “defame” with --defines--
Column 7, line 67 – Replace “is opposed” with --as opposed--
Column 9, line 2 – Replace “slid” with --slide--
Column 10, line 6 – Before “position” insert --the--
Column 11, line 49 – Replace “close” with --closed--
Column 12, line 27 – Replace “an fan” with --a fan--
Column 13, line 23 – Delete “In a” insert --A--
Column 14, line 15 – After “shutting” insert --off--
Column 14, line 16 – After “motor” insert --,--
Column 14, line 21 – Replace “multi-function” with --multifunction--
Column 14, line 31 – Replace “be” with --by--
Column 14, line 34 – Replace “multi-function” with --multifunction--
Column 14, line 40 – Replace “multi-function” with --multifunction--
Column 14, line 45 – Replace “multi-function” with --multifunction--
Column 14, line 50 – Replace “multi-function” with --multifunction--

Signed and Sealed this

Twenty-second Day of January, 2008

JON W. DUDAS
*Director of the United States Patent and Trademark Office*